US006706676B2

(12) United States Patent
Swensen

(10) Patent No.: US 6,706,676 B2
(45) Date of Patent: Mar. 16, 2004

(54) CLEANING COMPOSITION

(75) Inventor: Charles Christopher Swensen, Crofton, MD (US)

(73) Assignee: New Dawn Manufacturing Company, Upper Marlboro, MD (US)

( * ) Notice: Subject to any disclaimer, the term of this patent is extended or adjusted under 35 U.S.C. 154(b) by 76 days.

(21) Appl. No.: 10/147,205

(22) Filed: May 15, 2002

(65) Prior Publication Data

US 2003/0216268 A1 Nov. 20, 2003

(51) Int. Cl.[7] ..... C11D 1/14; C11D 1/22; C11D 3/30; C11D 3/43; C11D 3/50

(52) U.S. Cl. ..... 510/174; 510/101; 510/170; 510/240; 510/340; 510/342; 510/352; 510/357; 510/428; 510/499

(58) Field of Search ..... 510/101, 170, 510/174, 240, 340, 342, 352, 357, 428, 499

(56) References Cited

U.S. PATENT DOCUMENTS

| | | | | |
|---|---|---|---|---|
| 5,158,710 A | * | 10/1992 | VanEenam | 252/539 |
| 5,340,493 A | | 8/1994 | Principato | 252/462 |
| 5,437,808 A | | 8/1995 | Weltman et al. | 252/170 |
| 5,665,690 A | | 9/1997 | Lucas et al. | 510/407 |

* cited by examiner

*Primary Examiner*—Brian P. Mruk
(74) *Attorney, Agent, or Firm*—Armstrong, Kratz, Quintos, Harison & Brooks, LLP

(57) ABSTRACT

Disclosed is a cleaning composition for removing ink from a variety of surfaces. The composition has a low amount of volatile organic compounds (VOC) and a near neutral pH.

8 Claims, No Drawings

CLEANING COMPOSITION

FIELD OF THE INVENTION

The herein disclosed invention find applicability in the field of cleaning agents. More particularly, the cleaning compositions of the herein disclosed invention find applicability for cleaning surfaces of inks of various formulations and more particularly as a pressroom cleaner.

BACKGROUND OF THE INVENTION

There is a need in the field of cleaning agents and particularly in the field cleaning agents for efficiently removing printing inks from solid surfaces as well as from the hands and other parts of the body. The cleaning compositions must be environmentally friendly, and they must be able to safely clean a variety of inks. Disposal in a legal fashion, preferably down the waste water drain, without pretreatment is clearly desirable, as is the requirement for biodegradability.

Prior art inks can be solvent based, soy or other vegetable oil based, or water based. In recent times, the printing presses of American newspapers have been moving toward the use of soy based inks, due to health and environmental safety issues. Once the inks have been removed from the presses, walls, floors, etc., the effluent must be able to be easily disposed of, preferably down the drain, without causing problems with the water treatment plant. This disposal problem could arise from the use of alkali builders which cause a high pH or the use of cleaning agents with ingredients that are not biodegradable.

Presently, many cleaners being used are of high pH, contain ethylene glycol ethers, or if they contain a natural citrus solvent, they are generally not stable emulsions. The pH of cleaning compositions is a problem, because water treatment plants do not want to accept such a high pH effluent as it interferes with water treatment processes, often killing useful bacteria, causing waste to go untreated, or in addition, damaging equipment because of corrosivity. The use of ethylene glycol ethers presents a problem to workers who may inhale this toxic product or absorb it through the skin. The body has difficulty breaking down ethylene glycol ethers and thus may cause the formation of toxic compounds. Propylene glycol ethers are much safer, but to be effective, the amount of propylene glycol ether or ethylene glycol ether is usually quite high, leading to an end result of high VOC (volatile organic compound) content. VOC's are now regulated nationally by the EPA and, VOC content may also be regulated by state and local governments. Finally, the use of citrus terpenes, or d-limonene, although used by some manufacturers, has resulted in unstable emulsions with high pH's. The present invention seeks to eliminate these problems.

Prior Art Patents

Lucas et al (U.S. Pat. No. 5,665,690) teaches a low toxicity solvent cleaning composition containing tripropylene glycol methyl ether (col. 3, line 3), and d-limonene (col. 3, line 25). However, Lucas et al is not pertinent to the herein disclosed invention in that Lucas et al does not teach the use of a microemulsion and does not include water.

Weltman et al (U.S. Pat. No. 5,437,808) teaches an organic solvent cleaning solution. Among the ingredients of the cleaning composition are propylene glycol methyl ether; and further the composition is useful as a cleaning agent for dyes. This reference, like Lucas et al, is deficient in not providing for water in the cleaning composition.

Principato (U.S. Pat. No. 5,340,493) teaches compositions for cleaning ink. The composition can contain d-limonene (col. 5, line 33), propylene glycol monomethyl ether (col. 6, line 51). The herein disclosed invention is distinct from Principato in that Principato does not provide for a microemulsion and actually teaches against the use of water.

VanEenam (U.S. Pat. No. 5,158,710) discloses a stable aqueous cleaner/degreaser formulated in the form of a microemulsion. Included in the composition are dodecylbenzene sulfonic acid (col. 5, line 65), triethanolamine (col. 5, line 67), and monoethanolamine (col. 7, line 56). Note that at col. 23, Example 29 discloses a cleaner containing monoethanolamine, tripropyleneglycol monomethyl ether, dodecylbenzenesulfonic acid, water and defoamer. The cleaner of the herein disclosed invention is distinct from VanEanam in that VanEanam depends on the use of alkali builders in his product. On the other hand, the cleaning composition of the herein disclosed invention functions at a neutral pH.

Objects of the Invention

A main object of this invention is the formulation of a cleaning composition which will efficiently clean printing inks.

A further object of this invention is to produce a composition for removing ink from the hands, as well as, from printing equipment such as rollers.

A significant object of this invention is to produce a cleaning composition composed mainly of low volatility components.

An important object of this invention is to produce a composition which does not pollute the environment.

BRIEF SUMMARY OF THE INVENTION

The invention is directed to a cleaning composition and, more particularly, to an ink cleaning composition containing effective amounts of: water, d-limonene, propylene glycol methyl ether, anionic detergent emulsifier (mix of $C_8$–$C_{18}$ sulfonated surfactant), dodecylbenzene sulfonic acid, mono ethanolamine, dye, and defoamer. The composition can be used as a pressroom cleaner for removing ink from hands, presses, as well as, from walls and floors. The cleaning product of this invention can be used in a variety of print shops, on a variety of inks.

The inventor has found the cleaning composition of this invention to be effective for cleaning inks used by various newspapers. The newspaper inks tested were mainly oil based, soy based and reacted soy methyl ester based. The colors were colors such as black, blue, red and magenta. Besides being able to clean ink, the cleaning composition can effectively clean grease, grime, soap scum, nicotine stains as well as other soiled surfaces.

The cleaning composition may have d-limonene replaced with dibasic esters (DBE) such as dimethyl adipate, dimethyl glutarate and/or dimethyl succinate as well as terpenes such as pine oil terpene (CAS 8002-02-3). A mixture of d-limonene and dibasic esters has been found to be operative. For example, d-limonene may be partially or completely replaced by an equal amount of a dibasic ester selected from the group consisting of dimenthyl adipate, dimethyl glutarate, dimethyl succinate and mixtures thereof; and the terpene in the same amount replaces all or part of the d-limonene.

Throughout the disclosure the terms cleaning composition, ink-cleaning composition and cleaning formulation are used interchangeably.

EXAMPLES

In its broadest aspect, the invention envisions a composition useful for cleaning affected surfaces comprising effective amounts of:

Water,

D-Limonene,

Dipropylene Glycol Methyl Ether

Anionic Detergent Emulsifier (mix of $C_8$–$C_{18}$ sulfonated surfactant),

Dodecylbenezene Sulfonic Acid,

Mono Ethanolamine,

Dye,

Defoamer.

The examples and amounts set forth therein are exemplary of effective amounts.

A composition for cleaning affected surfaces comprising in substantially the following amounts:

| | |
|---|---|
| D-Limonene | 8.5 |
| Sodium Alkyl Sulfosuccinate ($C_{-8}$–$C_{-18}$) | 2.5–2.785 |
| Propylene Glycol | 0.6–0.75 |
| Dipropylene Glycol n-butyl Ether (CAS-29911-28-2) | 1.2–1.3 |
| Dodecylbenzene Sulfonic Acid (CAS-27176-87-0) | 7 |
| Mono Ethanol Amine | 1.5 |
| Dipropylene Glycol Methyl Ether (34590-94-8) | 3 |
| Water | 75–75.5 |
| Foam Ban HP720 ™ | Trace |
| Dye | Trace |

The inventor envisions his composition to be used in substantially the percentage ranges set forth as follows. These ranges constitute substantially effective amounts.

| Ingredient | Percentage |
|---|---|
| Water | 65–85 |
| D-Limonene | 5–15 |
| Dipropylene Glycol Methyl Ether | 3–10 |
| Anionic Detergent Emulsifier (mix of $C_8$–$C_{18}$ sulfonated surfactant) | 3–10 |
| Dodecylbenezene Sulfonic Acid | 3–10 |
| Mono Ethanolamine | 1–7 |
| Dye | <1 |
| Defoamer | <1 |
| pH | 7–8.5 |

A preferred formulation for the cleaning composition is substantially as set forth as follows:

| Ingredient | Percentage |
|---|---|
| D-Limonene | 8.50 |
| Sodium Alkyl Sulfosuccinate ($C_{-8}$–$C_{-18}$) | 5.00 |
| Dodecylbenzene sulfonic acid | 7.00 |
| Monoethanol amine | 1.50 |
| Water | 75 |
| Dipropylene glycol methyl ether | 3 |
| Foam Ban HP-720 ™ | Trace |

Dipropylene glycol methyl ether may be replaced by more D-Limonene in the same relative proportion.

The final product has a clear light yellow color and a citrus odor. The color may vary based on the dye used.

The anti-foaming agent is not critical to this invention. Examples of anti-foam agents can be found in Chemical Abstracts General Subject Index, Vol. 119, July–December 1993, page 320 GS.

Advantages and Benefits Derived From the Use of the Cleaning Agent of This Invention The ink cleaning composition of this invention is a concentrated micro-emulsion based on d-limonene and an anionic emulsifier, which allows for the creation of a stable neutral micro-emulsion, while at the same time, contributing added detergency to the end product. The use of the d-limonene and the added detergency of the emulsifier, allows for a decrease of the amount of VOC's in the product and eliminates any alkali builders. A typical end use concentration will give a VOC level of less than 2% by weight. The added detergency contributed by the emulsifier also adds to the wetting ability of the product, which further increases the penetration of the product into the ink. The reduced VOC's also enables the product to be used safely on multiple surfaces, such as metal, tile, stone, and also on most plastic and painted surfaces. Finally, the inventive cleaner is made up of 100% readily biodegradable raw materials.

A summary of the benefits for the cleaning composition of this invention are as follows:

Neutral pH micro-emulsion

Low VOC's

Rapid wetting and penetration of inks and soils

Readily biodegradable

The user can easily dispose of effluent

Safe to use on metal tile, stone, and most plastic and painted surfaces.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A cleaning composition for cleaning affected surfaces comprises effective amounts of Water, D-Limonene, Dipropylene Glycol Methyl Ether, Anionic Detergent Emulsifier Dodecylbenezene Sulfonic Acid, Mono Ethanolamine and Defoamer.

2. A cleaning composition for cleaning affected surfaces comprising in about the following amounts:

| Ingredient | Percentage |
|---|---|
| Water | 65–85 |
| D-Limonene | 5–15 |
| Dipropylene Glycol Methyl Ether | 3–10 |
| Anionic Detergent Emulsifier | 3–10 |
| Dodecylbenzene Sulfonic Acid | 3–10 |
| Mono Ethanolamine | 1–7 |
| Dye | <1 |
| Defoamer | <1 |
| pH | 7–8.5. |

3. A composition for cleaning affected surfaces comprising in about the following amounts:

| Ingredient | Percentage |
|---|---|
| D-Limonene | 8.50 |
| Sodium Alkyl Sulfosuccinate ($C_{-8}$–$C_{-18}$) | 5.00 |
| Dodecylbenzene sulfonic acid | 7.00 |
| Monoethanol amine | 1.50 |
| Water | 75 |
| Dipropylene glycol methyl ether | 3 |
| Defoamer | <1. |

4. A composition for cleaning affected surfaces comprising in about the following amounts:

| | |
|---|---|
| D-Limonene | 8.5 |
| Sodium Alkyl Sulfosuccinate ($C_{-8}$–$C_{-18}$) | 2.5–2.785 |
| Propylene Glycol | 0.6–0.75 |
| Dipropylene Glycol n-butyl Ether | 1.2–1.3 |
| Dodecylbenzene Sulfonic Acid | 7 |
| Mono Ethanol Amine | 1.5 |
| Dipropylene Glycol Methyl Ether | 3 |
| Water | 75 |
| Defoamer | <1 |
| Dye | <1. |

5. A cleaning composition for cleaning affected surfaces comprising in about the following amounts:

| Ingredient | Percentage |
|---|---|
| Water | 65–85 |
| D-Limonene | 8–25 |
| Anionic Detergent Emulsifier | 3–10 |
| Dodecylbenzene Sulfonic Acid | 3–10 |
| Mono Ethanolamine | 1–7 |
| Dye | <1 |

-continued

| Ingredient | Percentage |
|---|---|
| Defoamer | <1 |
| pH | 7–8.5. |

6. A cleaning composition of cleaning affected surfaces comprising in about the following amounts:

| Ingredient | Percentage |
|---|---|
| Water | 65–85 |
| A Dibasic Ester selected from the group consisting of dimethyl adipate, dimethyl glutarate, dimethyl succinate, and mixtures thereof | 5–15 |
| Dipropylene Glycol Methyl Ether | 3–10 |
| Anionic Detergent Emulsifier | 3–10 |
| Dodecylbenzene Sulfonic Acid | 3–10 |
| Mono Ethanolamine | 1–7 |
| Dye | <1 |
| Defoamer | <1 |
| pH | 7–8.5. |

7. A cleaning composition for cleaning affected surfaces comprising in about the following amounts:

| Ingredient | Percentage |
|---|---|
| Water | 65–85 |
| Terpene | 5–15 |
| Dipropylene Glycol Methyl Ether | 3–10 |
| Anionic Detergent Emulsifier | 3–10 |
| Dodecylbenzene Sulfonic Acid | 3–10 |
| Mono Ethanolamine | 1–7 |
| Dye | <1 |
| Defoamer | <1 |
| pH | 7–8.5. |

8. The cleaning composition of claim 7 wherein the terpene is pine oil.

* * * * *